US006233740B1

(12) United States Patent
Meyers et al.

(10) Patent No.: US 6,233,740 B1
(45) Date of Patent: May 22, 2001

(54) AIRCREW INTEGRATED RECOVERY SURVIVAL VEST

(75) Inventors: John Meyers, Lusby; Rodney Pursell, Patuxent River, both of MD (US); Enrich Armhein, Newtown; Richard Landry, Needham, both of MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/456,066

(22) Filed: Dec. 6, 1999

Related U.S. Application Data

(60) Provisional application No. 60/121,372, filed on Feb. 25, 1999.

(51) Int. Cl.[7] ..... A41D 1/04
(52) U.S. Cl. ..... 2/102; 2/94
(58) Field of Search ..... 2/102, 69, 94, 2/247, 271; 119/857, 907

(56) References Cited

U.S. PATENT DOCUMENTS

| | | | | |
|---|---|---|---|---|
| 2,448,076 | * | 8/1948 | Bradley | 2/49.3 |
| 4,512,437 | * | 4/1985 | Savage | 182/3 |
| 4,731,882 | * | 3/1988 | Ekman | 2/69 |
| 5,544,363 | * | 8/1996 | McCue et al. | 2/102 |
| 5,738,046 | * | 4/1998 | Williams et al. | 2/94 |
| 5,909,802 | * | 6/1999 | Puco et al. | 2/102 |
| 5,991,925 | * | 11/1999 | Wu | 2/102 |
| 6,035,440 | * | 3/2000 | Woodyard | 2/102 |
| 6,101,631 | * | 8/2000 | Ferguson, Jr. | 2/94 |

FOREIGN PATENT DOCUMENTS

| | | | | |
|---|---|---|---|---|
| 3222225 | * | 12/1983 | (DE) | 2/94 |

* cited by examiner

*Primary Examiner*—Rodney M. Lindsey
(74) *Attorney, Agent, or Firm*—Ron Billi

(57) ABSTRACT

A vest particularly suited for survival purposes is disclosed. The vest has removably attachable pockets as well as a removably attachable hoisting harness so as to facilitate the needs for survival and, in addition, has provisions for easily adjusting the size thereof.

21 Claims, 3 Drawing Sheets

AIRCREW INTEGRATED RECOVERY SURVIVAL VEST

This application claims the benefit of Provisional No. 60/121,372 filed Feb. 25, 1999.

BACKGROUND OF THE INVENTION 1.0 Field of the Invention

The present invention relates to a vest that is donned by a user and, more particularly, to a vest having removably attachable pockets to accommodate survival equipment and removably attachable hoisting harness usable during emergency conditions.

2.0 Description of the Prior Art

Vests comprise a sleeveless garment and are commonly donned by users and extend from the neck region to the waist region of the user. Vests also serve survival functions such as a life preserver for floatation purposes and as well as provide facilities, such as pockets, for housing survival equipment, such as knives. Vests find frequent usage in hunting and fishing activities.

Vests commonly comprise a relatively large amount of pockets having capacities to accommodate other survival equipment such as knives, hand warmers and pistols. It is desired that the vest be provided with removable pockets providing different storage capacities so that one vest may be customized to serve the unique requirements of the many different users donning essentially the same survival vest.

Vests are commonly donned by users that sometimes find themselves in dangerous situations requiring their immediate withdrawal therefrom by airborne machines, such as helicopters. These vests find frequent usage in police activities, such as SWAT teams, and drug enforcement agencies. It is desired that vests be provided with a hoisting harness to facilitate the removal by airborne equipment from dangerous situations. Further, it is desired that this hoisting harness be removable from the vest when desired.

Vests are also commonly donned by users having different body proportionate dimensions. Unless the size of the vest is adjustable the user may look sloppily dressed and, more importantly, the size of the vest may interfere with the activities, such as fishing, hunting and police enforcement, being undertaken by the user. It is desired to provide means for easily adjusting the size of the vest so that one vest accommodates the proportionate dimensions of many users.

OBJECTS OF THE INVENTION

It is a primary object of the present invention to provide a vest having removably attachable pockets.

It is a further object of the present invention to provide a vest having a removably attachable hoisting harness.

It is another object of the present invention to provide for a vest having means so as to adjust its proportionate dimensions so as to accommodate the different sizes of many users.

SUMMARY OF THE INVENTION

The present invention provides for a survival vest having removable and attachable pockets, as well as a removable and attachable hoisting harness and, in addition thereto, means for adjusting its size so as to easily accommodate different users that wear the vest.

The vest is capable of being donned by a user and covers the upper body portion of the user and extends from the neck to the waist of the user. The vest, in one embodiment, has at least one, but preferably three, separable regions that are brought together by at least one, but preferably three, straps that are inserted into rows of loops and thereafter detachably connected to the vest so that the user of the vest may quickly and easily adjust the size of the vest to make it form fit the user. The vest, in another embodiment, comprises means for adjusting the size thereof, a cutout, a removably attachable hoisting harness, removably attachable pockets, a snap link, and a lift strap. Means for adjusting changes the size of the vest so as to accommodate the proportionate dimensions of the individual user that wears the vest. The cutout is in the shoulder region of the vest so as to provide a passageway thereat. The lift strap has first and second ends with the first end passing through the passageway and having means for affixing to the snap link. The lift strap has a second end affixed to the removably attachable hoisting harness.

BRIEF DESCRIPTION OF THE DRAWINGS

These and other objects, features and advantages of the invention, as well as the invention itself, will become better understood by reference of the following description when considered in conjunction with the accompanying drawings, wherein like reference numbers designate identical or corresponding parts throughout and wherein.

DETAILED DESCRIPTION OF THE PREFERRED EMBODIMENTS

Figure 1:
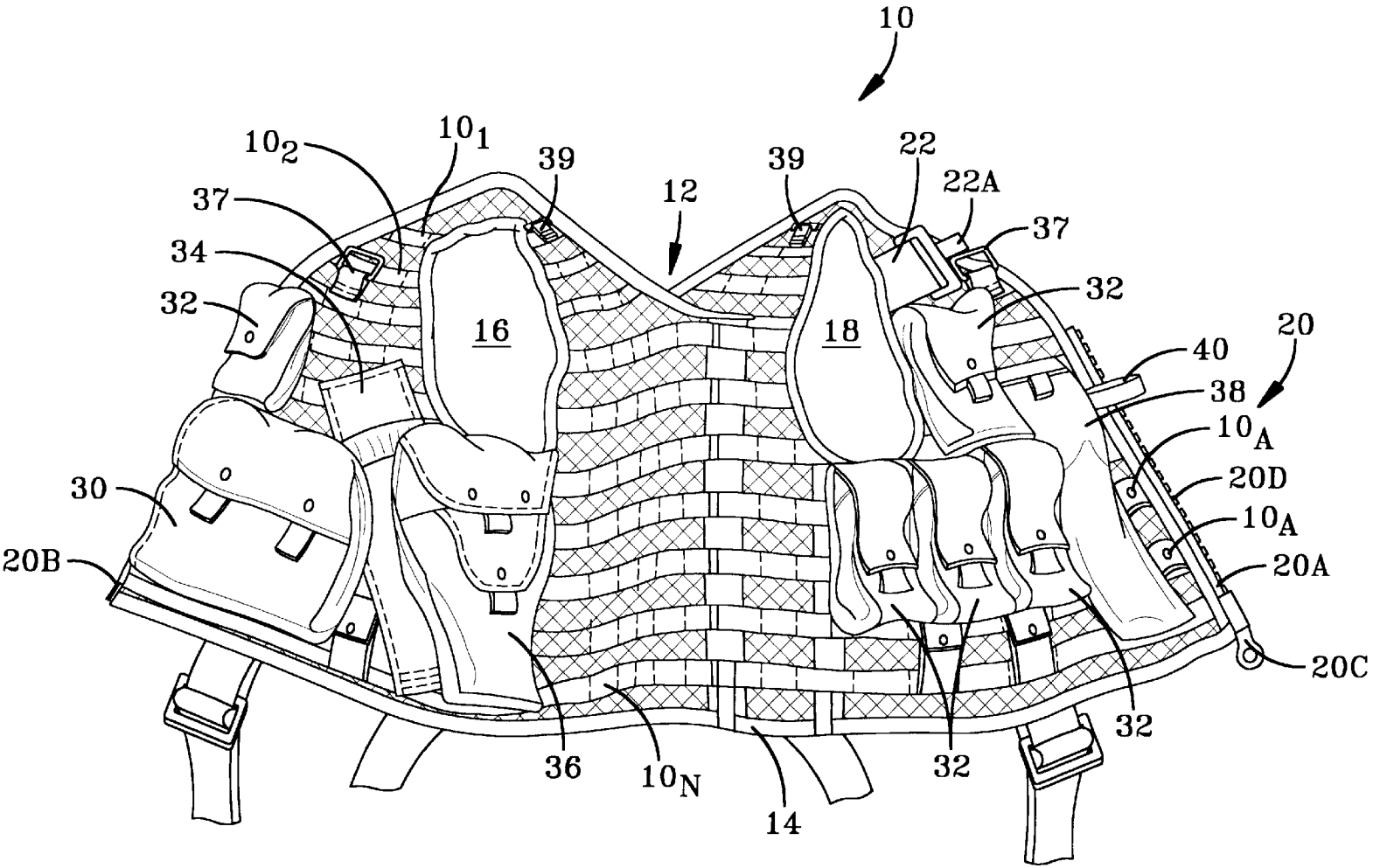
FIG. 1 is a front view of the vest of the present invention in its open position.

With reference to the drawing, FIG. 1 illustrates a front view of the vest 10 of the present invention shown in its open position. The vest 10 is capable of being donned by a user and covers the upper body portion of the user extending from the neck region 12 to the waist 14 of the user. The vest 10 has a plurality of rows $\mathbf{10}_1$, $\mathbf{10}_2$ . . . $\mathbf{10}_N$ and is fabricated so as to provide for openings 16 and 18 for the insertion of the left and right arms, respectively, of the user. The size of the vest 10 is adjustable, which is of particularly importance to the present invention, so as to accommodate the proportionate dimensions of the user in a manner to be further described with reference to FIG. 3.

The vest 10 of FIG. 1 vest further comprises a zipper assembly 20 having portions 20A and 20B that are attached to the vest 10 of the separated sides of the vest 10 shown in FIG. 1, in a manner known in the art, and also has a slide fastener 20C and plastic teeth 20D.

Figure 2:
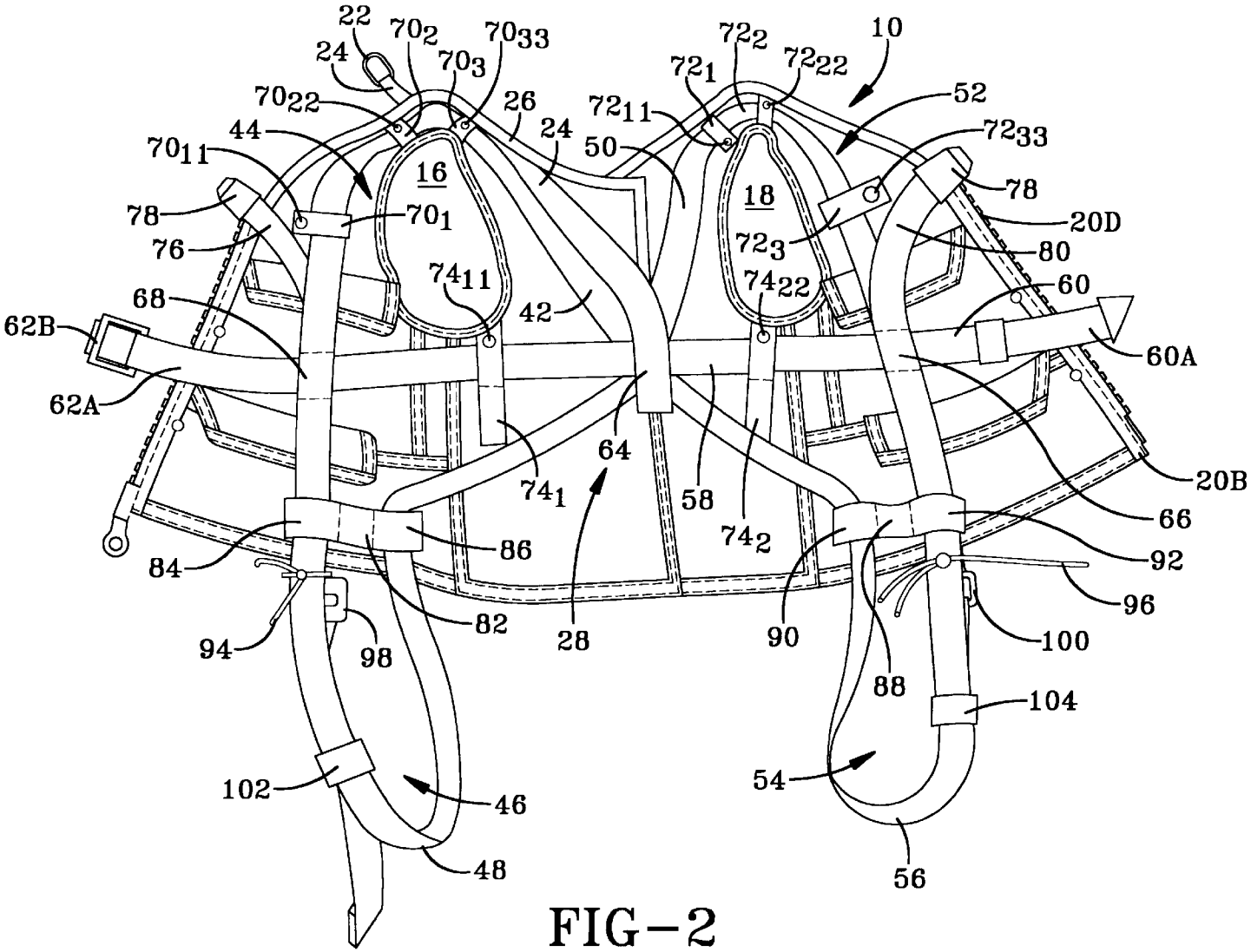
FIG. 2 is a rear view of the vest arranged in its open position.

The vest further comprises a snap link 22 (not fully shown) having a cover 22A, a lift strap 24 (not shown in FIG. 1 but shown in FIG. 2), and a cut-out in the vest 10 proximate shoulder region of the vest 10 so as to provide a passageway 26 (partially shown in FIG. 2) thereat. The strap 24 has first and second ends with the first end passing through the passageway 26 and having means for affixing to the snap link 22, and with the second end of strap 24 being affixed to a removably attachable hoisting harness 28, to be described hereinafter with reference to FIG. 2.

The vest 10 of FIG. 1 further comprises removably attachable pockets 30, 32, 34, 36, and 38, as well as a flashlight attachment 40. The vest further comprises two collar lobe attachments 37 and two loop locs 39. The pockets 30, 32, 34, 36 and 38 may be removably attachable to the vest 10 by appropriate means, such as interlaced webbing, known in the art. More particularly, the vest 10 has a snap button devices 10A which, when unbuttoned, allow the bands at the respective row $10_1$, $10_2$ . . . $10_N$ to be loosed and then interlaced with loops of the removable pockets 30, 32, 34, 36 and 38 and, finally, the snap button 10A is buttoned and the removable pockets 30, 32, 34, 36 and 38 are removably attached to the vest.

The pocket 30 is dimensioned so as to accommodate a typical radio, whereas pockets 32 are dimensioned to accommodate various items, such as hand warmers and other survival equipment. The pocket 34 is dimensioned so as to accommodate a Helicopter Emergency Egress Device (HEED) and for a Helicopter Aircrew Breathing Device (HABD) both known in the art, whereas pocket 36 is dimensioned so as to serve as a pistol holster, as well as an ammunition keeper. The pocket 38 is typically dimensioned to accommodate a survival knife.

The vest 10 is preferably comprised of a nylon material and also comprises a fire resistant material. The lift strap 24 and the removably attachable hoisting harness 28 are each preferably comprised of a nylon material. The removable attachable hoisting harness 28 has a figure eight pattern and may be further described with reference to FIG. 2 which is a rear view of the vest 10 in its open position.

The removably attachable hoisting harness 28 comprises a right strap 42 formed in a loop having a central region from which the right strap 42 extends upward to the right shoulder region 44 of the vest 10, then downward past the waist portion 14 of the vest 10 and continuing downward to the right leg 46 region of the user that dons the vest. The right strap 42 continues downward from the right leg region 46 to a peak 48 and then extends upward from the peak 48 back to the central region of the right strap 42.

The removably attachable hoisting harness 28 further comprises a left strap 50 formed in a loop having a central region from which the left strap 50 extends upward to the left shoulder region 52 of the vest 10 and continues downward to the left leg region 54 of the user. The left strap 50 has a peak 56 and from which the left strap 50 extends upward back to its central region.

The removably attachable hoisting harness 28 comprises a chest strap 58 having a central region from which the chest strap 58 extends outward in two directions identified by extending portions 60 and 62 respectively forming first and second ends 60A and 62A respectively. The second end 62A has a connector 62B affixed thereto which has means for capturing and releasably holding the other end 60A of the chest strap 58.

The removably attachable hoisting harness 28 further comprises means, such as stitching generally indicated by reference number 64, for affixing together the central region of the right strap 42, left strap 50, and chest strap 58. The means for affixing further comprises stitching generally indicated by reference number 66 so as to affix the portion 60 of the chest strap 58 to the left strap 50. Further, the means for affixing comprises stitching means, generally indicated by reference number 68 for affixing the portion 62 of the chest strap 58 to the right strap 42.

The vest 10 further comprises a plurality of right clamping straps $70_1$, $70_2$, and $70_3$ located in the right shoulder region 44 of the vest 10 with one of the right clamping straps $70_3$ being located proximate the passageway 26. Each of the right clamping straps $70_1$, $70_2$, and $70_3$, has first and second ends with one end thereof affixed to the vest 10 and the other end thereof having means, such as rigidly attached buttons $70_{11}$, $70_{22}$ and $70_{33}$ respectively, for being releasably attached to the vest 10. The first and second ends are separated from each other by a sufficient distance to allow the right strap 42 to pass under and therebetween.

The vest 10 further comprises a plurality of left clamping straps $72_1$, $72_2$, and $72_3$ which are similar to the right clamping straps $70_1$, $70_2$, and $70_3$. Each of the left clamping straps $72_1$, $72_2$, and $72_3$, has first and second ends with one end thereof affixed to the vest 10 and the other end thereof having means such as rigidly attached buttons $72_{11}$, $72_{22}$ and $72_{33}$ respectively, for being releasably attached to the vest 10. The first and second ends of the left clamping straps $72_1$, $72_2$, and $72_3$ are separated from each other by a sufficient distance to allow the right strap 50 to pass under and therebetween.

The vest 10 further comprises a plurality of chest clamping straps $74_1$, $74_2$ located in the chest region of the vest 10. Each of the chest clamping straps $74_1$, and $74_2$ has first and second ends with one end affixed to the vest 10 and the other end thereof having means, such as button snap arrangements $74_{11}$ and $74_{22}$ respectively, for being releasably attached to the vest 10. The first and second ends of the chest clamping straps $74_1$ and $74_2$ are separated from each other by a sufficient distance so as to allow the chest strap 58 to pass under and therebetween.

The hoisting harness 28 further preferably comprises a first support strap 76 having first and second ends with the first end affixed to the joinder region 68 of the right strap 42 and the chest strap 58. The second end of the support strap 76 is connected to the vest by attaching means 78.

The hoisting harness 28 still further comprises a second support strap 80 that is affixed to both the left strap 50 and the chest strap 58 at the joinder region 66 previously described. The second strap 80 has a second end connected to the vest 10 by means of the attachment means 78.

The hoisting harness 28 further comprises a right leg retainer 82 having first and second ends spaced apart from each other and located proximate the waist portion 14 of the vest 10 with one end of the right leg retainer 82 affixed to the right strap 42 portion that extends downward toward the peak 48 and with the other end of the right leg retainer 82 affixed to the right strap 42 portion that extends upward from the peak 48. The affixing of the right leg retainer 82 to the right strap 42 is generally indicated by reference numbers 84 and 86.

The hoisting harness 28 further comprises a left leg retainer 88 having first and second ends spaced apart from each other and located proximate the waist portion 14 of the vest 10 with one of the ends affixed to the portion of the left strap 50 by means such as stitching, generally indicated by reference number 90, that extends downward toward the peak 56 and with the other end of the left leg retainer 88 being affixed to the portion of the left strap 50 that extends upward from the peak 46 by means such as stitching, generally indicated by reference number 92.

The vest 10 further comprises harness retainer cords 94 and 96 that are affixed to the waist portion 14 of the vest 10 and located so as to be capable of intercepting and capturing the right and left straps 42 and 50 respectively. The right strap 42 preferably further comprises an adjustment device 98, whereas the left strap 50 further comprises an adjustment device 100. Similarly, the right strap 42 further comprises a harness keeper 102, whereas the left strap 50 further comprises a harness keeper 104.

It should now be appreciated that the practice of the present invention provides for a vest used for survival purposes and having removably attachable pockets as well as a removably attachable hoisting harness.

Figure 3:
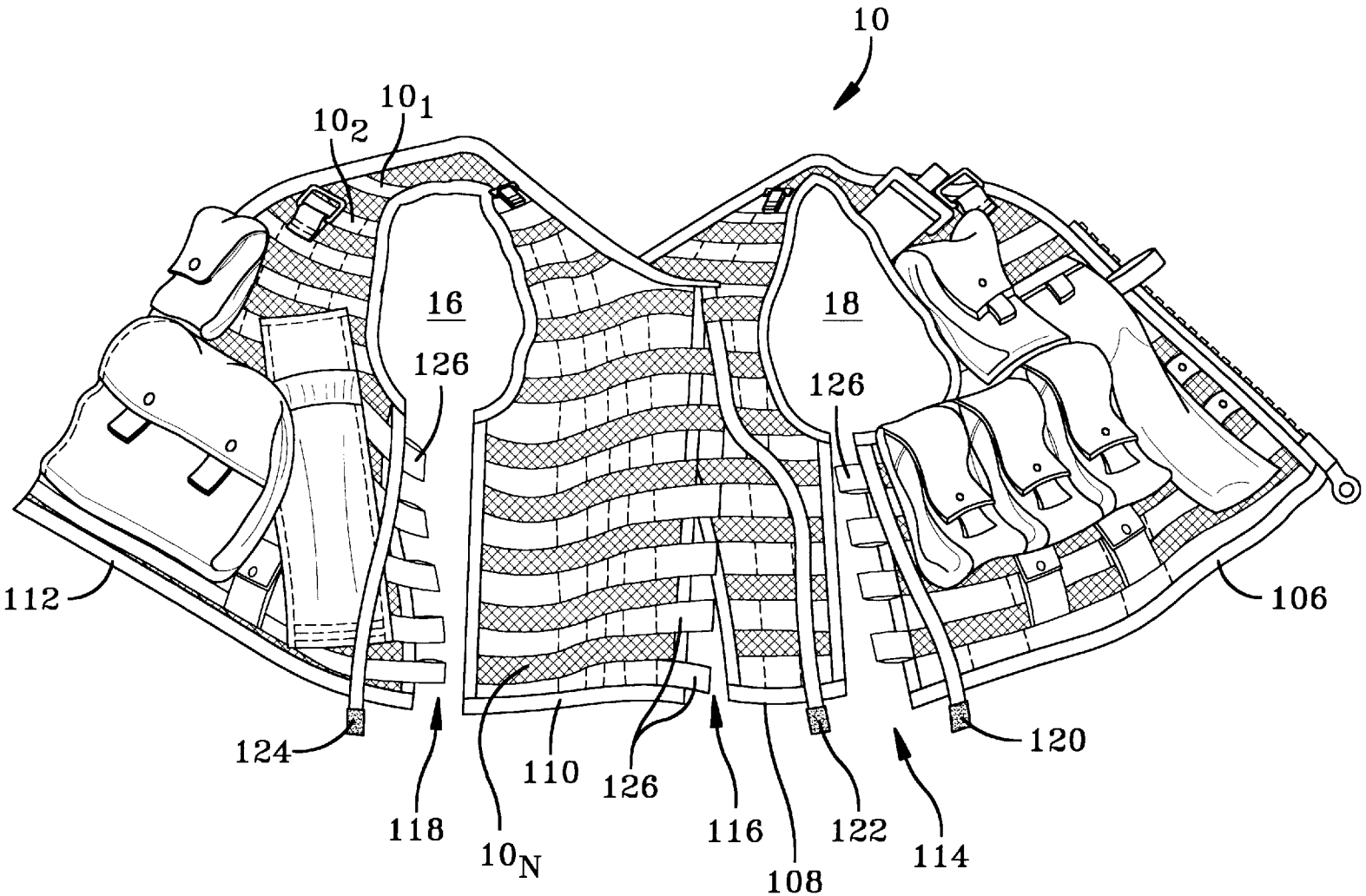
FIG. 3 illustrates the means for adjusting the size of the vest of FIGS. 1 and 2.

The vest 10 provides a unique adjustment method which may be further described with reference to FIG. 3. FIG. 3 illustrates the vest 10 having provisions known in the art so as to be capable of being separated into four sections 106, 108, 110 and 112, wherein sections 106 and 108 are separable at a first region 114 under the arm opening 18, sections 108 and 110 are separable at a second region 116 generally in the middle of the back of the vest 10, and sections 110 and 112 are separable at a third region 118 under the other arm opening 16.

FIG. 3 further illustrates a right insertion strap 120 located proximate the first region 114, a back insertion strap 122 located proximate the second region 116, and a left insertion strap 124 located proximate the third region 118. Each of the straps 120, 122 and 124 have attachment means, such as velcro or other devices known in the art, at its ends and is interlaced through respective horizontal loops 126 arranged in rows along the vest 10 as shown in FIG. 3.

From FIG. 3 it may be determined that the four sections 106, 108, 110 and 112 may be arranged so as to overlap one another so that the size of the vest 10 may be adjusted to accommodate the body dimensions of the user of the vest 10, then the straps 120, 122 and 124 may be interlaced into respective horizontal loops 126, and finally the velcro ends of the straps 120, 122 and 124 may be attached to the vest 10 and the vest 10 is now customized to match the size of the wearer of the vest 10. As used herein, the size of the vest 10 is meant to represent the distance around the horizontal circumference of the vest 10. Adjustments for the size of the wearer are provided, for example, in one-half (½) inch increments, under each arm and in the back area of the vest 10 in a manner as described for the use of straps 120, 122, and 124.

If desired, the practice of this invention may be accomplished by providing a vest 10 having the openings for the insertion of the arms and a back region for covering the back of the user and then providing at least one separable region dividing the vest 10 into at least two sections, with the at least separable region being located in the region selected from the group consisting of under one of said arm openings and in the middle of the back region of the vest 10. The vest 10 would further comprise at least one row of loops respectively located proximate the at least one separable region; and at least one insertion strap dimensioned to be insertable into one row of loops and respectively located proximate the separable region. The insertion strap has one end with means for detachably attaching to the vest.

Further, if desired the vest 10 may have more than four separable sections so long as the sections are brought together in a manner as described for the embodiment of FIG. 3.

It is understood that the invention is not limited to its specific embodiments herein illustrated and described but may be otherwise without departing from the spirit and scope of the invention.

What we claim is:

1. A vest that is capable of being donned by a user and covers the upper body portion of the user extending from the neck to the waist of the user, said vest comprising:

(a) means for adjusting the size of the vest so as to accommodate the proportionate dimensions of the user;

(b) a cutout in the shoulder region of the vest so as to provide a passageway thereat;

(c) a hoisting harness removeably attachable to said vest;

(d) removably attachable pockets;

(e) a snap link; and (f) a lift strap having first and second ends with the first end passing through said passageway and having means for affixing to said snap link and with the second end affixed to said removably attachable hoisting harness.

2. A vest that is capable of being donned by a user and covers the upper body portion of the user extending from the neck to the waist of the user, said vest comprising:

(a) means for adjusting the size of the vest so as to accommodate the proportionate dimensions of the user;

(b) a cutout in the shoulder region of the vest so as to provide a passageway in the right shoulder region of said vest;

(c) removeably attachable hoisting harness comprising;

(i) a left strap formed in a loop having a central region from which the left strap extends upward to the left shoulder region of the vest then downward past the waist portion of the vest and continuing downward to the left leg region of the user that dons the vest and has a peak and then extends upward from said peak and back to its central region;

(ii) a right strap formed in a loop having a central region from which the right strap extends upward to the right shoulder region of the vest then downward past the waist portion of the vest and continuing downward to the right leg of the user that dons the vest and has a peak and then extends upward from the peak and back to its central region;

(iii) a chest strap having a central region from which the chest strap extends outward in opposite directions respectively to form first and second ends;

(iv) a plurality of left clamping straps spaced apart from each other and located in the left shoulder region of said vest with one of said left clamping being located proximate said passage, each of said plurality of left clamping straps having first and second ends with one end thereof affixed to said vest and the other end thereof having means for being releasably attachable to said vest, said first and second ends being separated from each other by a sufficient distance so as to allow said left strap to pass therebetween;

(v) a plurality of right clamping straps spaced apart from each other and located in the right shoulder region of said vest, each of said plurality of right clamping straps having first and second ends with one end thereof affixed to said vest and the other end thereof having means for being releasably attachable to said vest, said first and second ends being separated from each other by a sufficient distance so as to allow said right strap to pass therebetween;

(vi) a plurality of chest clamping straps located in the chest region of said vest, each of said plurality of chest clamping straps having first and second ends with one end thereof affixed to said vest and the other end thereof having means for being releasably attachable to said vest, said first and second ends being separated from each other by a sufficient distance so as to allow said chest strap to pass therebetween;

(vii) a left leg retainer having first and second ends spaced apart from each other and located proximate the waist portion of said vest with one of said ends affixed to said left strap that extends downward toward said peak and with the other end affixed to said left strap that extends upward from said peak;

(viii) a right leg retainer having first and second ends spaced apart from each other and located proximate the waist portion of said vest with one of said ends affixed to said right strap that extends downward toward said peak and with the other end affixed to said right strap that extends upward from said peak;

(ix) a connector affixed to one end of said chest strap and having means for gripping and releasably holding the other end of said chest strap; and (x) means for affixing together the central regions of said left, right, and chest straps and means for affixing a portion of the oppositely extending chest strap respectively to said left and right straps (d) removeably attachable pockets;

(e) a snap link; and (f) a lift strap having first and second ends with the first end passing through said passageway and having means for affixing to said snap link and with the second end affixed to said removeably attachable hoisting harness.

3. The vest according to claim 1 further comprising a first support strap having first and second ends with the first end connected to a means for affixing a portion of the oppositely extending chest strap to a left strap and with the second end thereof connected to said vest.

4. The vest according to claim 1 further comprising a second support strap having first and second ends with the first end connected to a means for affixing a portion of the oppositely extending chest strap to a right strap and with the second end thereof connected to said vest.

5. The vest according to claim 2 further comprising left and right retainer cords both affixed to a waist region of the vest and located so as to be capable of intercepting and capturing said left and right straps respectively.

6. The vest according to claim 1, wherein said vest is comprised of a nylon material.

7. The vest according to claim 6, wherein said vest is comprised of a fire resistant material.

8. The vest according to claim 1 further comprising a zipper assembly having plastic teeth.

9. A vest that is capable of being donned by a user and covers the upper body portion of the user extending from the neck to the waist of the user, said vest having first and second openings for insertion of arms and a back region covering the back of said user, said vest comprising:

(a) means for adjusting the size of the vest so as to accommodate the proportionate dimensions of the user; said means for adjusting comprising;

(i) first, second and third separable regions dividing said vest into four sections, with the first separable region being located under one of said arm openings of said vest, said second separable region being located in the middle of said back region of said vest, and said third separable region being located under the other arm opening;

(ii) first, second, and third rows of loops respectively located proximate said first, second and third separable regions;

(iii) first, second and third insertion straps dimensioned to be insertable into said loops and respectively located proximate said first, second, and third separable regions, each of said first, second, and third insertion straps having one end with means for detachably attaching to said vest;

(b) a cutout in the shoulder region of the vest so as to provide a passageway thereat;

(c) removeably attachable hoisting harness;

(d) removeably attachable pockets;

(e) a snap link; and (f) a lift strap having first and second ends with the first end passing through said passageway and having means for affixing to said snap link and with the second end affixed to said removeably attachable hoisting harness.

10. A vest having first and second openings for insertion of arms and a back region covering the back of a user and having means for adjusting the size of the vest comprising:

(a) at least one separable region dividing said vest into at least two sections with the at least one separable region being located in the region selected from the group consisting of under one of said arm openings and in the middle of said back region of said vest;

(b) at least one row of loops respectively located proximate said at least one separable region; and (c) at least one insertion strap dimensioned to be insertable into said loops and respectively located proximate said separable region, said insertion strap having one end with means for detachably attaching to said vest.

11. A vest having first and second openings for insertion of arms and a back region covering the back of a user having means for adjusting the size of the vest comprising:

(a) first, second and third separable regions dividing said vest into four sections, with the first separable region being located under one of said arm openings of said vest, said second separable region being located in the middle of said back region of said vest, and said third separable region being located under the other arm opening;

(b) first, second, and third rows of loops respectively located proximate said first, second and third separable regions; and (c) first, second and third insertion straps dimensioned to be insertable into said loops and respectively located proximate said first, second, and third separable regions, each of said first, second, and third insertion straps having one end with means for detachably attaching to said vest.

12. The vest according to claim 2 further comprising a first support strap having first and second ends with the first end connected to a means for affixing a portion of the oppositely extending chest strap to said left strap and with the second end thereof connected to said vest.

13. The vest according to claim 2 further comprising a second support strap having first and second ends with the first end connected to a means for affixing a portion of the oppositely extending chest strap to said right strap and with the second end thereof connected to said vest.

14. The vest according to claim 2, wherein said vest is comprised of a nylon material.

15. The vest according to claim 2, wherein said vest is comprised of a fire resistant material.

16. The vest according to claim 2 further comprising a zipper assembly having plastic teeth.

17. The vest according to claim 9 further comprising a first support strap having first and second ends with the first end connected to a means for affixing a portion of the oppositely extending chest strap to a left strap and with the second end thereof connected to said vest.

18. The vest according to claim 9 further comprising a second support strap having first and second ends with the first end connected to a means for affixing a portion of the oppositely extending chest strap to a right strap and with the second end thereof connected to said vest.

19. The vest according to claim 9, wherein said vest is comprised of a nylon material.

20. The vest according to claim 9, wherein said vest is comprised of a fire resistant material.

21. The vest according to claim 9 further comprising a zipper assembly having plastic teeth.

* * * * *